United States Patent [19]

Bailey et al.

[11] Patent Number: 4,590,987

[45] Date of Patent: May 27, 1986

[54] METHOD AND APPARATUS FOR DETERMINING FLOW PATTERN OF MOLTEN METAL CASTING CHARGE

[75] Inventors: Francis V. Bailey, Oak Creek; John J. Waskiewicz, Wauwastosa, both of Wis.

[73] Assignee: Outboard Marine Corporation, Waukegan, Ill.

[21] Appl. No.: 473,770

[22] Filed: Mar. 10, 1983

[51] Int. Cl.[4] ..... B22D 2/00

[52] U.S. Cl. ..... 164/457; 164/150; 374/102; 374/139

[58] Field of Search ..... 164/457, 150; 374/102, 374/116, 139, 186; 73/861.05

[56] References Cited

U.S. PATENT DOCUMENTS

| | | | |
|---|---|---|---|
| 3,864,973 | 2/1975 | Petry | 164/150 X |
| 4,213,494 | 7/1980 | Carbonnel | 164/155 X |
| 4,245,758 | 1/1981 | McCabe | 164/457 X |

FOREIGN PATENT DOCUMENTS

| | | | |
|---|---|---|---|
| 56-19967 | 2/1981 | Japan | 164/457 |
| 56-163071 | 12/1981 | Japan | 164/457 |
| 57-94625 | 6/1982 | Japan | 374/139 |
| 57-88944 | 6/1982 | Japan | 164/150 |

*Primary Examiner*—Nicholas P. Godici
*Assistant Examiner*—J. Reed Batten, Jr.
*Attorney, Agent, or Firm*—Michael, Best & Friedrich

[57] ABSTRACT

The time history of a molten metal casting charge being introduced into a mold cavity is recorded by an electrically operated recorder including a plurality of electrical circuits, each of which produces a timing signal upon being completed or closed and is connected to an electrical timing lead having an electrically bare, free end adapted to be located in the mold cavity. The free ends of the timing leads are positioned at predetermined locations of interest in the mold cavity and the molten metal serves as a common ground for completing the electrical circuits in the recorder. The timing cycle is started in response to the molten metal contacting the electrically bare, free end of an electrical trigger lead located near the inlet of the mold cavity and electrically connected to the recorder. Time signals, indicative of the elapsed time between the starting time and the time the molten metal reaches each of the predetermined locations in the mold cavity, are produced in response to the molten metal contacting the free ends of the timing leads.

8 Claims, 1 Drawing Figure

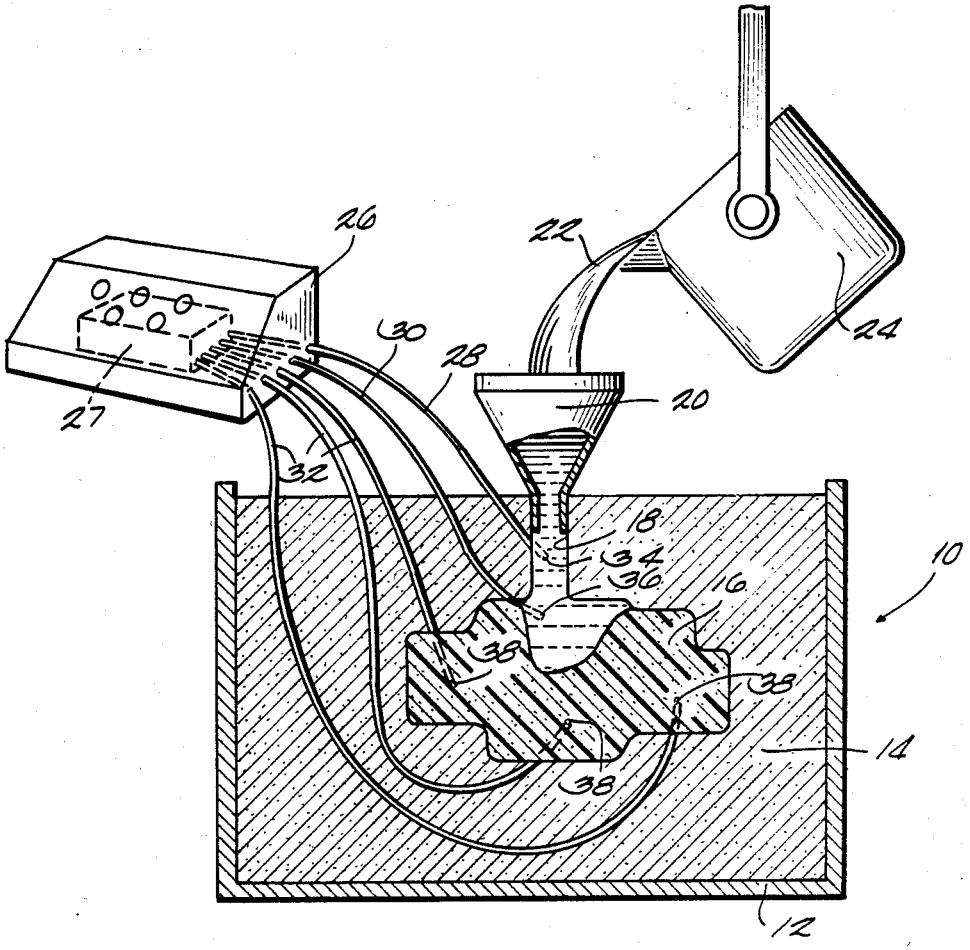
26
22
24
30
28
20
27
32
18
34
36
16
10
38
38
14
38
12

METHOD AND APPARATUS FOR DETERMINING FLOW PATTERN OF MOLTEN METAL CASTING CHARGE

BACKGROUND OF THE INVENTION

This invention relates to casting electrically conductive, molten materials and, more particularly, to a method and apparatus for determining the flow pattern of the casting charge of a molten, electrically conductive, molten material as it fills a mold cavity.

For some metal casting operation, it is desirable to have an inexpensive method and apparatus for determining the effect different process variables have on the flow pattern of the molten metal as it fills the mold cavity. This is particularly true for so-called lost foam casting processes in which the mold cavity is formed by a pattern in the shape of a cast part and made from a material, such as polystyrene, which is vaporized upon being contacted by the molten metal. These vapors are diffused into a porous material, such as sand, surrounding the pattern. Consequently, a test mold made from a substantially impervious, transparent material, such as quartz glass, can not be used to study the flow pattern of the molten metal in such a process.

Heretofore, high powered X-ray films, infrared pictures and devices employing thermocouples have been used for this purpose. These prior techniques and devices generally require relatively highly skilled personnel, are quite expensive, and/or provide results which can be easily misinterpreted.

Attention is directed to the following United States patents:

| Patentee | U.S. Pat. No. | Issue Date |
|---|---|---|
| Heimgartner | 3,537,295 | Nov. 3, 1970 |
| Slamar | 3,893,502 | July 8, 1975 |
| Terkelsen | 3,931,847 | Jan. 13, 1976 |
| Carbonnel | 4,213,494 | July 22, 1980 |

SUMMARY OF THE INVENTION

The invention provides apparatus for determining the flow pattern of an electrically conductive molten material as it is introduced into a mold cavity of an electrically insulating mold, which apparatus includes a first electrical conduction sensing means adapted to be positioned in the vicinity of the inlet opening of the mold cavity, a plurality of second electrical conduction sensing means adapted to be positioned at different predetermined locations in the mold cavity, and an electrically operated recording means electrically connected to the first and second electrical conduction sensing means and being operable to start a timing cycle in response to the molten material being introduced into the mold cavity contacting the first electrical conduction sensing means and to record the elapsed time from the start of the timing cycle to the time the molten material reaches each of the predetermined locations in the mold cavity in response to the molten material contacting the second electrical conduction sensing means.

In one embodiment, the first electrical conduction sensing means includes an electrical trigger lead having an electrically bare, free end adapted to be positioned in the vicinity of the inlet opening of the mold cavity, the second electrical conduction sensing means includes a plurality of electrical timing leads, each having an electrically bare, free end adapted to be positioned at different predetermined locations in the mold cavity, and the recording means is electrically connected to the trigger and timing leads and is operable to start the timing cycle in response to the molten material contacting the free end of the trigger lead and to record the elapsed time from the start of the timing cycle to the time the molten material reaches each of the predetermined locations in the mold cavity in response to the molten material contacting the free ends of the timing leads.

In one embodiment, the recording means includes a plurality of electrical circuits for producing a signal indicative of the elapsed time from the start of the timing cycle in response to being connected to ground, each of the timing leads is connected to one of such electrical circuits, and such electrical circuits are connected to ground in response to the molten material contacting the free end of a respective one of the timing leads.

The invention provides a method for determining the flow pattern of an electrical conductive, molten material as it is introduced into a mold cavity of an electrical insulating mold which method includes the steps of producing an electrical starting signal for starting a timing cycle in response to an electrical conduction sensing means being contacted by the molten material as it is first introduced into the mold cavity, producing a plurality of electrical timing signals in response to the molten material contacting electrical sensing means positioned at different predetermined locations in the mold cavity, and providing means for receiving the starting and timing signals and recording the elapsed time between the starting signal and each of the timing signals.

One of the principal features of the invention is the provision of an inexpensive, reliable method and apparatus for determining the flow pattern of an electrical conductive, molten material as it is introduced into a mold cavity of an electrically insulating mold.

Another of the principal features of the invention is the provision of such a method and apparatus employing a plurality of electrical conduction sensing means adapted to be located at various predetermined locations within the mold cavity an an electrically operated recording means connected to the electrical conduction sensing means and operable to produce and record timing singals indicative of the elasped time for the molten material to reach locations corresponding to the electrical conduction sensing means.

A further of the principal features of the invention is the provision of a method and apparatus described in the next preceding paragraph employing a recording means having electrical circuits which produce a timing signal upon being completed or closed and which are connected to the electrical conduction sensing means so that the molten material serves as a ground for completing the respective electrical circuits as the molten material contacts the electrical conduction sensing means.

Other features, aspects and advantages of the invention become apparent to those skilled in the art upon reviewing the following detailed description, the drawing and the appended claims.

BRIEF DESCRIPTION OF THE DRAWING

The single FIGURE is a schematic representation of apparatus embodying various of the features of the invention.

Before explaining the embodiments of the invention in detail, it is to be understood that the invention is not limited in its application to the details of construction and the arrangement of components set forth in the following description or illustrated in the drawing. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENTS

The method and apparatus of the invention can be used to determine the flow pattern of castings made from a wide variety of electrically conductive materials and made by various different casting techniques. The method and apparatus is particularly adaptable for use with metal castings made by a so-called lost foam molding process and will be described in connection with that particular process.

Schematically illustrated in the drawing is a sand casting mold 10 for casting parts from an electrically conductive metal, such as steel. The mold 10 includes a molding box 12 containing sand 14 or another electrically insulating, gas porous material surrounding a pattern 16 in the shape of the part to be cast and a pouring inlet or gate 18 in the sand 14 for receiving a funnel 20 into which a molten metal 22 is poured from a ladle 24 or the like. The pattern 16 is made from polystyrene or other suitable material which vaporizes upon being contacted by the molten metal 22. The pattern 16 is eventually completely vaporized and these vapors are diffused into the sand 14, leaving a mold cavity which becomes filled with the molten metal 22. The mold 10 usually also includes risers or similar means (not shown) for ensuring that the mold cavity is properly filled and compensating for shrinkage.

The invention provides a method and apparatus for automatically recording the time required for the molten metal 22 to reach various predetermined locations inside the mold cavity as it is filled with the molten metal 22 during the casting operation. More specifically, the apparatus includes an electrically operated recording means 26 which is operable to start a timing cycle in response to the molten metal 22 starting to fill the mold cavity, i.e, when the molten metal 22 contacts the top portion of the pattern 16, and to record the elapsed time from the start of the timing cycle to the time the molten metal 22 reaches various predetermined locations in the mold cavity.

In the specific embodiment illustrated, the recording means 26 is a conventional microprocessor, or the like, including a plurality of conventionally arranged electrical circuits (illustrated schematically at 27) which produces a signal upon being completed or closed, together with an electrical ground lead 28, an electrical trigger lead 30, and a plurality of electrical timing leads 32, all of which are electrically connected to the microprocessor 26. The specific arrangement of the electrical circuits 27 is not an essential part of the invention and, therefore, need not be described or illustrated in detail for one skilled in the art to fully understand the invention. Any conventional circuit arrangement capable of producing a signal for recording upon being completed or closed can be used.

The ground lead 28 is electrically connected to the common ground of the microprocessor 26. The ground lead 28 extends through the sand 14 and has an electrically bare, free end 34 located in the mold inlet 18.

The trigger lead 30 is electrically connected to an electrical circuit in the microprocessor 26 which, upon being completed or closed, starts a timing cycle. The trigger lead 30 extends through the sand 14 and has an electrically bare, free end 36 which, prior to introduction of the molten metal 22, is located in the uppermost portion of the pattern 16.

Each timing lead 32 is connected to a separate electrical circuit in the microprocessor 26 which, upon being completed or closed, produces a timing singal. Each timing lead 32 extends through the sand 14 and has an electrically bare, free end 38 which, prior to introduction of the molten metal 22, is located in the pattern 16 at a predetermined location corresponding to a location of interest in the mold cavity.

Holes for receiving the free ends 36 and 38 of the trigger and timing leads 30 and 32 can be punched or otherwise suitably formed in the pattern 16. It can be appreciated that the free ends 36 and 38 of the trigger and timing leads 30 and 32 are located in what would be the mold cavity for other types of molds which do not employ a lost foam pattern.

As the molten metal 22 is introduced into the mold, it first contacts the free end 34 of the ground lead 28 and, because of its electrical conductivity, the molten metal becomes the common ground for the electrical circuits in the microprocessor 26. When the molten metal 22 has vaporized the uppermost portion of the pattern 16 and contacts the free end 36 of the trigger lead 30, the electrical circuit connected to the trigger lead 30 is completed or closed and produces a signal for starting a timing cycle. When the molten metal 22 contacts the free end 38 of each timing lead 32 (as the pattern 16 continues to vaporize), the electrical circuits connected to the respective timing leads 32 are completed or closed and produce signals indicative of the elapsed time between the time the molten metal 22 first reached the location of the free end 36 of the trigger lead 30 and the time it first reached the location of the free end 38 of a particular timing lead 32.

The timing signals are recorded on magnetic tape, memory circuit means or the like (not shown) in a conventional manner to provide a time history of the timing circuit closures. This record preferably is in a form permitting it to be processed in a conventional manner to provide a printout which can be reviewed to determine the flow pattern of the molten metal 22 as it fills the mold cavity. Such records can be made for a number of fillings to determine the effect different process variables has on the flow characteristics of the molten metal as it fills the mold cavity.

For molding techniques employing an open molding cavity, the free end 36 of the trigger lead 30 usually will be located in a lowermost portion of the mold cavity and the free ends 38 of the timing leads 32 will be located above the trigger lead so as to provide the time history of the molten metal filling the mold cavity upwardly from the bottom.

Various features of the invention are set forth in the following claims:

We claim:

1. Apparatus for determining the flow pattern of an electrically conductive molten material as the molten material is introduced into a mold cavity of an electrically insulating mold having an inlet opening for the molten material, said apparatus comprising first electrical conduction sensing means adapted to be positioned in the vicinity of the inlet opening of the mold cavity, a plurality of second electrical conduction sensing means respectively adapted to be positioned at different predetermined locations in the mold cavity, and electrically operated recording means electrically connected to said first and second electrical conduction sensing means and being operable to start a timing cycle in response to the molten material being introduced into the mold cavity contacting said first electrical conduction sensing means and to record the elapsed time from the start of the timing cycle to the time the molten material reaches each of the predetermined locations in the mold cavity in response to the molten material contacting said second electrical conduction sensing means.

2. Apparatus according to claim 1 wherein said first electrical conducting sensing means includes an electrical trigger lead having a free end adapted to be positioned in the vicinity of the inlet opening of the mold cavity, wherein said plurality of second electrical conduction sensing means includes a plurality of electrical timing leads each having a free end adapted to be positioned at different predetermined locations in the mold cavity, and wherein said recording means is electrically connected to said trigger and timing leads and is operable to start the timing cycle in response to the molten material contacting the free end of said trigger lead and to record the elapsed time from the start of the timing cycle to the time the molten material reaches each of the predetermined locations in the mold cavity in response to the molten material contacting the free ends of said timing leads.

3. Apparatus according to claim 2 wherein said recording means includes a plurality of electrical circuits for producing a signal to indicate the elapsed time from the start of the timing cycle in response to being connected to ground, and wherein each of said timing leads is connected to one of said electrical circuits and said electrical circuits are connected to ground in response to the molten material contacting the respective free ends one of said timing leads.

4. Apparatus according to claim 2 wherein the mold cavity is formed by a pattern in the shape of the material to be molded and made from a material which vaporizes upon being contacted by the molten material, wherein said mold includes a material surrounding the pattern which is porous to the vapors of the pattern, and wherein said timing leads are adapted to extend through the porous material with said free ends located in the pattern.

5. Apparatus for determining the flow pattern of an electrically conductive molten material as the molten material is introduced into a mold cavity of an electrically insulating mold having an inlet opening for the molten material, said apparatus comprising first electrical conducting sensing means adapted to be positioned in the vicinity of the inlet opening of the mold cavity, a second electrical conduction sensing means adapted to be positioned at a different predetermined location in the mold cavity, and electrically operated recording means electrically connected to said first and second electrical conduction sensing means and including means for starting a timing cycle in response to contact with said first electrical conduction sensing means by molten material being introduced into the mold cavity and for recording the elapsed time from the start of the timing cycle to the time the molten material reaches the predetermined location in response to contact with said second conduction sensing means by the molten material.

6. A method for determining the flow pattern of an electrically conductive molten material as the molten material is introduced into a mold cavity of an electrically insulating mold, said method including the steps of producing an electrical starting signal for starting a timing cycle in response to an electrical conduction sensing means being contacted by the molten material as it is first introduced into the mold cavity, producing a plurality of electrical timing signals in response to the molten material contacting electrical conduction sensing means positioned at different predetermined locations in the mold cavity, and providing means for receiving the starting and timing signals and recording the elasped time between the starting signal and each of the timing signals.

7. A method according to claim 5 including providing first conduction sensing means positioned in the vicinity of the inlet opening of the mold cavity, providing a plurality of second electrical conduction means positioned at predetermined locations in the mold cavity, and providing an electrically operated recording means which is connected to said first and second electrical conduction sensing means and is operable to start a timing cycle in response to the molten material contacting the first electrical conduction means and to record the elapsed time from the starting cycle to the time the molten material reaches each of the predetermined locations in the mold cavity in response to the molten material contacting the second electrical conduction sensing means.

8. A method for determining the flow pattern of an electrically conductive molten material as the molten material is introduced into a mold cavity of an electrically insulating mold, said method including the steps of producing an electrical starting signal for starting a timing cycle in response to an electrical conduction sensing means being contacted by the molten material as it is first introduced into the mold cavity, producing an electrical timing signal in response to the molten material contacting electrical conduction sensing means positioned at a different predetermined location in the mold cavity, and providing means for receiving the starting and timing signals and recording the elapsed time between the starting signal and the timing signal.

* * * * *